US007901024B2

(12) United States Patent
De Meutter

(10) Patent No.: US 7,901,024 B2
(45) Date of Patent: Mar. 8, 2011

(54) METHOD OF INKJET PRINTING

(75) Inventor: Stefaan De Meutter, Antwerp (BE)

(73) Assignee: Agfa Graphics NV, Mortsel (BE)

( * ) Notice: Subject to any disclaimer, the term of this patent is extended or adjusted under 35 U.S.C. 154(b) by 155 days.

(21) Appl. No.: 12/443,502

(22) PCT Filed: Oct. 8, 2007

(86) PCT No.: PCT/EP2007/060645

§ 371 (c)(1),
(2), (4) Date: Mar. 30, 2009

(87) PCT Pub. No.: WO2008/043728

PCT Pub. Date: Apr. 17, 2008

(65) Prior Publication Data

US 2009/0315930 A1 Dec. 24, 2009

Related U.S. Application Data

(60) Provisional application No. 60/854,240, filed on Oct. 25, 2006.

(30) Foreign Application Priority Data

Oct. 12, 2006 (EP) ..... 06122178

(51) Int. Cl.
*B41J 2/205* (2006.01)

(52) U.S. Cl. ..... 347/15; 347/43

(58) Field of Classification Search ..... 347/15, 347/40, 43, 12, 41, 14; 358/1.2, 1.9
See application file for complete search history.

(56) References Cited

U.S. PATENT DOCUMENTS

| | | | | |
|---|---|---|---|---|
| 6,059,393 | A | 5/2000 | Takahashi | |
| 6,378,972 | B1 | 4/2002 | Akiyama et al. | |
| 6,631,963 | B1 * | 10/2003 | Ando et al. | 347/15 |
| 7,552,985 | B2 * | 6/2009 | Kawatoko et al. | 347/15 |
| 2004/0061731 | A1 | 4/2004 | Fujimura et al. | |

FOREIGN PATENT DOCUMENTS

EP 1 524 117 A2 4/2005

OTHER PUBLICATIONS

Official Communication issued in International Patent Application No. PCT/EP2007/060645, mailed on Feb. 8, 2008.
"Partial Dot Overlap Method for Grey Scale Printing", IBM Technical Disclosure Bulletin, vol. 36, No. 2, Feb. 1993, pp. 269-271.

* cited by examiner

*Primary Examiner* — Lamson D Nguyen
(74) *Attorney, Agent, or Firm* — Keating & Bennett, LLP

(57) ABSTRACT

A method of inkjet printing includes using a grayscale inkjet print head. The inkjet print head is driven driving to eject a number of successive ink droplets from the ink chamber in accordance with print tone data provided to the grayscale print head, the number of successive ink droplets forming a multiple-droplet drop creating a printed dot of appropriate tone on the receiving medium. The method includes the step of excluding print tone data corresponding with the ejection of a single-droplet drop from being provided to the grayscale print head. A preferred embodiment includes the removal of this print tone data from the data provided to the grayscale print head. A more preferred embodiment includes applying a multilevel halftoning technique for avoiding the use of print tone data corresponding with a single-droplet drop during the generation of the print tone data for inkjet printing the image with the grayscale print head.

13 Claims, 6 Drawing Sheets

METHOD OF INKJET PRINTING

CROSS-REFERENCE TO RELATED APPLICATIONS

This application is a 371 National Stage Application of PCT/EP2007/060645, filed Oct. 8, 2007. This application claims the benefit of U.S. Provisional Application No. 60/854,240, filed Oct. 25, 2006, which is incorporated by reference herein in its entirety. In addition, this application claims the benefit of European Application No. 06122178.4, filed Oct. 12, 2006, which is also incorporated by reference herein in its entirety.

BACKGROUND OF THE INVENTION

1. Field of the Invention

The present invention relates to methods of operating droplet deposition apparatus, in particular an inkjet print head, comprising a chamber communicating with a nozzle for ejection of ink droplets and with a supply of ink, the print head further comprising an electrically actuable device associated with the chamber and actuable a plurality of times to eject a corresponding number of droplets. In particular, it relates to a print head in which the chamber is a channel having associated with it a device arranged to vary the volume of the channel in response to an electrical signal.

2. Description of the Related Art

EP 0 422 870 discloses the concept of "multipulse grayscale printing", i.e. firing a variable number of ink droplets from a single channel within a short period of time, the resulting "packet" of droplets merging in flight and/or on the paper to form a correspondingly variable-size printed dot in the paper. An inkjet print head incorporating this technique is now commercially available, e.g. the OmniDot 760/GS8 from Xaar (UK). The channels in this print head are separated one from the next by side walls which extend in the lengthwise direction of the channels. In response to electrical signals, the channel walls are displaceable transverse to the channel axis. This in turn generates acoustic waves that travel along the channel axis, causing droplet ejection from a nozzle located at one end of the channel, as well-known in the art. In EP 0 968 822 a method for driving a multipulse grayscale print head is disclosed. The driving method is based on the generation of a series of drive pulses applied to the electrodes of piezoelectric channel walls. A first voltage pulse deforms the piezoelectric channel walls so as to increase the volume of the ink chamber and create a negative pressure in the ink chamber; a subsequent voltage pulse decreases the volume of the ink chamber and increases the pressure in the ink chamber thereby ejecting a droplet from the ink chamber. The voltage pulses are then removed from the electrodes to bring the ink chamber back to its original volume. This sequence of drive pulses may be repeated a number of times corresponding to the number of droplets to be ejected successively for merging into a single variable-size drop. This sequence of drive pulses is often referred to as a waveform for generating a variable-size drop.

Multipulse grayscale print heads, also referred to as multidroplet print heads or simply grayscale print heads, are appreciated for their high print quality using the 'variable-size drop' feature. A drawback of multipulse grayscale print heads is lack of drop speed uniformity of the variable-size drops. It is for example known that the first droplet ejected from the print head is slower than successive droplets ejected within the same packet, i.e. within the same drop. This may be advantageous towards merging of subsequent droplets into the first droplet, but it is a disadvantage if the first droplet is printed on its own as a single drop. In other words, the average velocity of a single droplet drop is often lower than the average velocity of a multiple droplet drop. As a difference in average velocity results in a difference in flight time from the print head to a receiving medium, a single droplet drop usually hits the receiving medium at a later instance than a multiple droplet drop ejected at the same time. In inkjet printing applications, a relative movement between an inkjet print head and a receiving medium enables the printing of dots at predefined locations (raster or grid points) on the receiving medium. With this relative movement, a different landing time on the receiving medium therefore results in undesired dot placement variations from the ideal raster point location. This often limits the use of multipulse grayscale print heads to printing speeds below 0.5 m/s. The printing speed is the relative velocity between the receiving medium and the multipulse grayscale print head during printing.

In the prior art, different solutions have been proposed to equalize the average velocity of multipulse grayscale drops. A solution disclosed in U.S. Pat. No. 6,402,282 is to introduce an additional time delay between the application of successive drive signals generating successive droplets from a given channel. The time delay is chosen such that a variation in the average velocity at which the corresponding droplets travel to the receiving medium remains below a given value. The time delay is referred to as the channel dwell time. Unfortunately, adding time delays to a sequence of drive pulses reduces the maximum printing speed of the print head.

Another approach includes the application of a boost pulse prior to the application of the drive signal generating the first droplet. This boost pulse inputs an amount of energy in the ink chamber, prior and in addition to the energy provided through the drive signal of the first droplet. The additional energy input increases the energy available in the ink chamber for ejecting the first droplet and also increases the average velocity of the first droplet when ejected. The boost pulse is only applied prior to the drive signal for ejecting the first droplet and therefore does not affect successive droplets. So the velocity of the first droplet is increased while the velocity of successive droplets is theoretically maintained. In practice however, there remains a difference between the velocity of the first droplet and that of successive droplets, which make this approach not suitable for high speed printing applications. The application of a boost pulse prior to the main ejection pulse is disclosed in U.S. Pat. No. 6,857,715 and U.S. Pat. No. 6,231,151.

In patent application WO 98/08687, changes in drop velocity of multidroplet drops can be regulated by modifying the amplitude of the electrical drive signal pulses. Compared to the drive method disclosed in EP 0 968 822 this approach requires electronic drive circuitry allowing the voltage amplitude to vary between individual drive pulses in a sequence of drive pulses generating a multidroplet drop. This requirement adds costs and complexity to the print head drive electronics.

In summary, some prior art regarding equalizing the velocity of multidroplet drops from a multipulse grayscale print head focus on tailored waveforms to increase the velocity of the single-droplet drop relative to that of the multi-droplet drops, or to reduce the velocity of multi-droplet drops relative to that of the single-droplet drop. Other prior art focuses on tailored electronic drive circuitry to adjust voltage amplitude of the applied waveforms. They share the same objective of reducing drop velocity variations, thereby also reducing dot placement errors on a receiving medium. They also share the same disadvantage in that these approaches are not open to end users or system integrators of multipulse grayscale print heads, i.e. drive waveforms and print head driver electronics are usually proprietary to the print head manufacturer. Nonetheless, printing systems for industrial printing applications, combining high speed with high quality, and thus requiring high drop velocity uniformity, are developed by system integrators in close cooperation with end users. A need exist to equalize drop velocity in multipulse grayscale inkjet printing applications in a manner that is open to system integrators or end users.

SUMMARY OF THE INVENTION

In order to overcome the problems described above, preferred embodiments of the present invention provide a method for driving a multipulse grayscale print head wherein the drop velocities of the various multidroplet drops ejected from the multipulse grayscale print head are equalized within acceptable limits so that the print head can be used in high speed industrial printing applications.

The above-mentioned advantages and benefits are achieved by providing a method for driving a multipulse grayscale print head wherein each multidroplet drop ejected from the print head comprises at least two droplets.

Specific features of preferred embodiments of the present invention are set out below.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Piezoelectric inkjet printers employ the inverse piezoelectric effect, which causes certain crystalline materials to change shape when a voltage is applied across them. In piezoelectric inkjet a shape deformation of the crystalline material (piezoelectric ceramics) is used to decrease the volume of a chamber wherein ink is contained, resulting in squeezing ink out through a nozzle in a wall of the chamber. Depending on the piezoelectric ceramics' deformation mode, the technology can be classified into four main types: squeeze, bend, push, and shear. In a shear mode print head, the electric field causing the desired deformation of the piezoelectric ceramics is designed to be perpendicular to the polarization of the piezoelectric ceramics. The description will further focus on shear mode piezoelectric print heads, as for example developed and manufactured by Xaar (UK).

State of the art shear mode technology allows high quality grayscale printing wherein multiple small ink droplets are ejected successively from a single nozzle within a short period of time, allowing these droplets to merge in flight into a single drop or merge on the receiving media into a single dot. The number of small ink droplets ejected and merged into a single drop is variable thereby providing a technology capable of printing variable-size dots onto a receiving medium.

Figure 1:
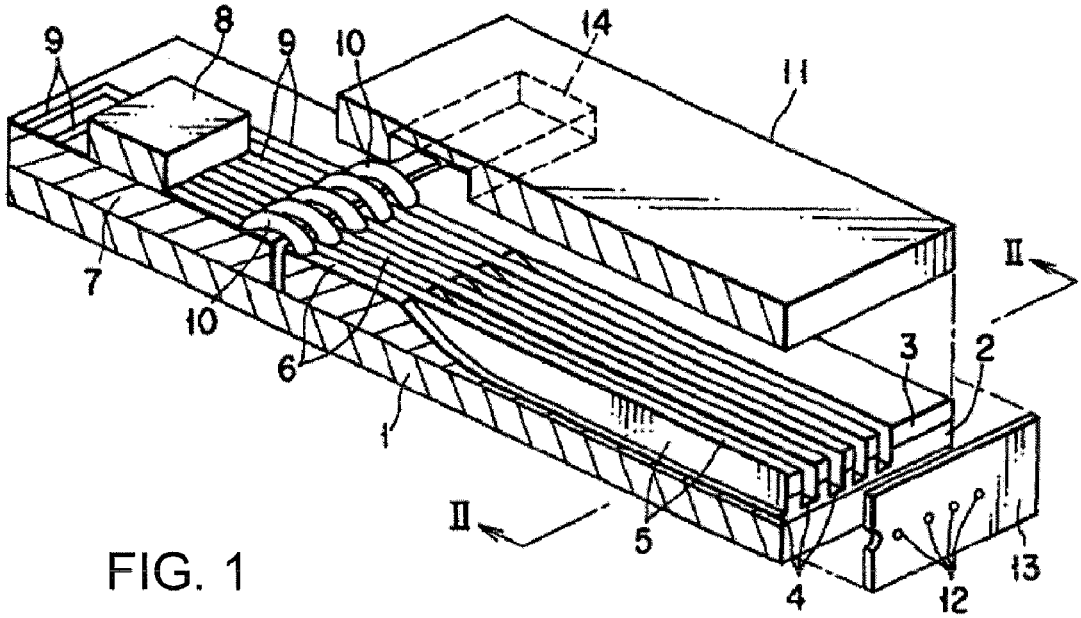
FIG. 1 shows an exploded perspective view wherein a part of an exemplary multipulse grayscale print head is cut away.
Figure 2:
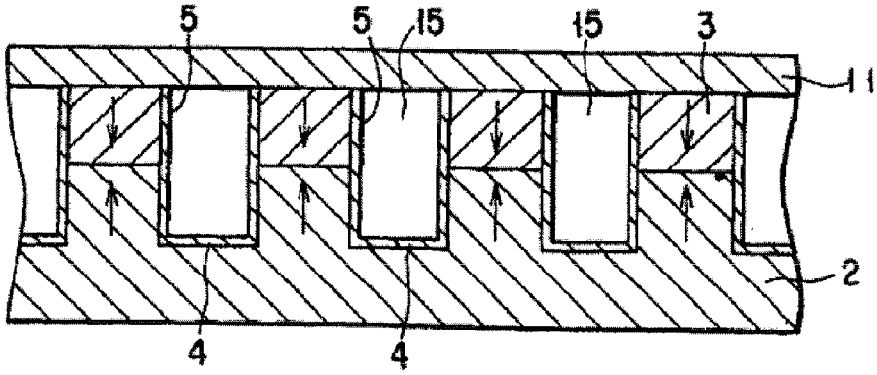
FIG. 2 shows a partial cross-sectional view of the exemplary inkjet print head of FIG. 1, cut along a line II-II without the substrate.

A detailed description of a multipulse grayscale print head using shear mode technology is disclosed in EP 0 968 822 B1. A multipulse grescale print head may have a multitude of closely spaced parallel ink channels having channel separating, piezoelectric displaceable, walls. Each channel is actuable by one or both of the displaceable side walls. In a typical arrangement, an external electrical connection is provided to an electrode in each channel and when a voltage difference is applied between the electrode corresponding to one channel and the electrodes of the neighboring channels, the walls separating the channels are displaced causing the volume of the one channel, depending on the voltage sign, to expand or to contract causing an ink drop to be ejected from a nozzle communicating with the channel. FIG. 1 is an exploded perspective view showing a typical inkjet print head partially cut away, incorporating piezoelectric wall actuators operating in shear mode. It comprises two sheets of rectangular piezoelectric members 2 and 3 adhered and fixed to one side of the surface of a substrate 1 made of a ceramic material, by an epoxy resin adhesion. A plurality of long grooves 4 which are disposed in parallel at a predetermined interval and have an equal width, and equal depth, and an equal length are formed in the piezoelectric members 2 and 3 by a diamond cutter. Electrodes 5 are formed on the side surface and the bottom surface of the long grooves 4, and lead electrodes 6 are formed from rear ends of the long grooves 4 to the rear upper surface of the piezoelectric member 3. These electrodes 5 and 6 are formed by electroless nickel plating. A printed circuit board 7 is adhered and fixed to the other end of the surface of the substrate 1. A drive IC 8 including a drive circuit is mounted on the printed circuit board, and conductive patterns 9 connected to the drive IC 8 are formed also on the printed circuit board. Further, the conductive patterns 9 are respectively connected to the lead electrodes 6 through wires 10 by wire bonding. A top plate 11 made of a ceramics is adhered and fixed to the piezoelectric member 3 by an epoxy resin adhesion. In addition, a nozzle plate 13 provided with a plurality of orifices 12 is adhered and fixed to the top end of each of the piezoelectric member 2 and 3. In this manner, the upper portions of the long grooves 4 are covered by the top plate 11, and the top ends thereof are closed by the nozzle plate 13, such that each of the grooves forms an ink chamber which acts as a pressure chamber. A common ink chamber 14 is formed in the top plate 11, and rear end portions of the ink chambers formed by the long grooves 4 communicate with the common ink chamber 14. Further, the common ink chamber 14 communicates with an ink supply system (not shown). FIG. 2 is a partial cross-sectional view showing the inkjet print head having the structure shown in FIG. 1, cut along a line II-II without the substrate 1. Side walls of the ink chambers 15 formed by the long grooves 4 are made of piezoelectric members 2 and 3 which are respectively polarized in directions opposed to each other along the plate-thickness, as indicated by the arrows.

Figure 3A:
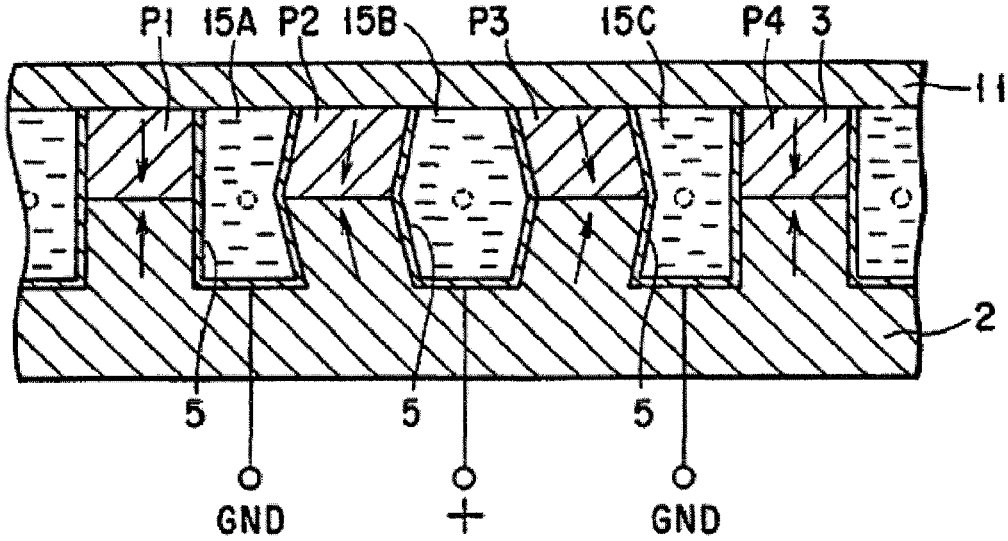
FIGS. 3A and 3B are views for explaining the droplet ejection process in the exemplary inkjet print head of FIG. 1.
Figure 3B:
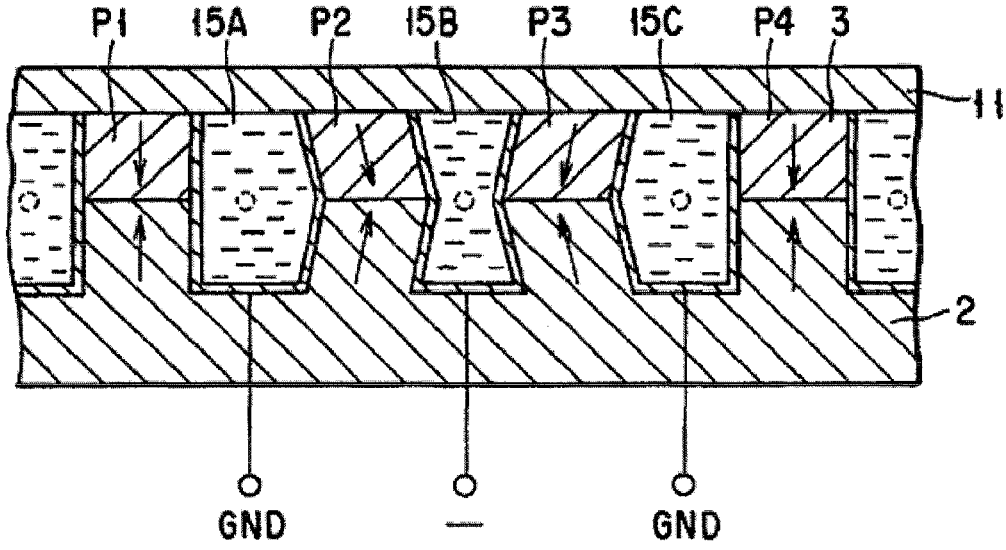

Next, operational principles of the inkjet print head described above will be explained with reference to FIGS. 3A and 3B. On condition that each ink chamber 15 is filled with ink, attention is paid to three ink chambers 15A, 15B, and 15C partitioned by side walls P1, P2, P3, and P4 made of piezoelectric members 2 and 3. Supposing that the electrode 5 of the center ink chamber 15B is applied with a positive voltage and the electrodes 5 of both adjacent ink chamber 15A and 15C are set to a ground potential (GND), then both the side walls P2 and P3 of the ink chamber 15B are respectively polarized in directions opposed to each other in the film-thickness direction, and therefore, the side walls P2 and P3 are rapidly deformed outwards so as to enhance the volume of the ink chamber 15B. By this deformation, a negative pressure is introduced in the ink chamber 15B and ink is supplied to the ink chamber 15B from the common ink chamber 14. From this state, the electrode 5 of the center ink chamber 15B is next applied with a negative voltage while the electrodes 5 of both the adjacent ink chambers 15A and 15C are maintained at the ground potential resulting, as shown in FIG. 3B, in both the side walls P2 and P3 of the ink chamber 15B rapidly deforming inwards so as to reduce the volume of the ink chamber 15B. This volume reduction of the ink chamber 15B imposes a positive pressure in ink chamber 15B, thereby pushing an ink droplet out of the orifice 12 at the end of the ink chamber 15B. From this state, the potential of the electrode 5 of the ink chamber 15B is further changed to the ground potential, and then, the side walls P2 and P3 rapidly recover their original position. By this recovery operation, the tail of the ink droplet pushed out of the orifice 12 is cut and the ink droplet flies towards the receiving medium.

Figure 4:
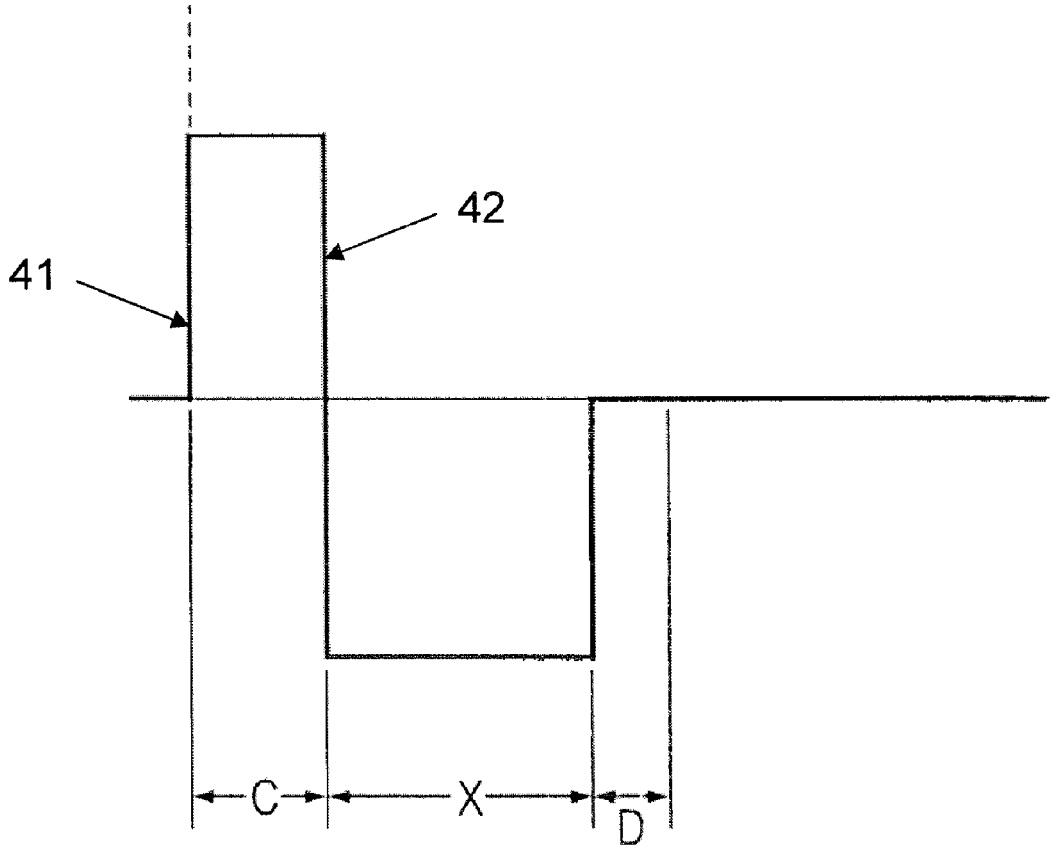
FIG. 4 shows an actuating waveform for driving the ejection of a droplet in the exemplary inkjet print head of FIG. 1.

FIG. 4 illustrates the actuating waveform driving the ejection of a droplet from the orifice 12 of the ink chamber 15B. The actuating voltage magnitude is indicated on the ordinate and normalized time on the abscissa. The channel expansion period is indicated as "C" and has a duration DR. The channel expansion period is followed substantially immediately thereafter by a channel contraction period "X" of duration 2 DR, followed in turn by a period "D" of duration 0.5 DR in which the channel dwells into a condition in which it is neither contracted nor expanded. The waveform combines the teaching of D. B. Bogy et al related to wave propagation and ejection of droplets in drop-on-demand inkjet devices, published in the IBM Journal of Research and Development, Vol. 28, No. 3, May 1984, and the teaching of A. Scardovi related to the cancellation of pressure waves in drop-on-demand inkjet devices, published in U.S. Pat. No. 4,743,924.

Following the dwell period, the waveform can be repeated as appropriate to eject further droplets in the multidroplet drop generation process. The number of droplets ejected successively from the ink chamber 15 in a multidroplet drop generation process is determined by print tone data provided to the inkjet print head for that ink chamber. Print tone data is representative for the gray-value associated with the image pixel that is to be reproduced on the receiving medium by the printing of an ink drop. In multidroplet drop ejection inkjet processes, the print tone data that is input to the print head determines the number of droplets in a multidroplet drop and therewith the drop volume of the multidroplet drop and size of the printed dot on the receiving medium. The frequency at which multidroplet drops may be ejected from each of the ink chambers 15 of the print head is referred to as the operating fire frequency of the print head.

Commercially available print heads that use the above described multipulse grayscale technology include the Omni-Dot 760/GS8 print head from Xaar (UK), with a basic droplet volume of 8 pL and 6 gray levels. Ideally the print head delivers 0 pL at 0 dpd, 8 pL at 1 dpd, 16 pL at 2 dpd, 24 pL at 3 dpd, 32 pL at 4 dpd, and 40 pL at 5 dpd. The term 'dpd' refers to droplets-per-drop. The Omnidot 760/GS8 print head is delivered with an embedded standard drive waveform as illustrated in FIG. 4.

A multipulse grayscale print head CA3 is also available from Toshiba Tec (JP), with a basic droplet volume of 6 pL and 8 gray levels.

Another multipulse grayscale print head is available from Agfa-Gevaert (BE) as the UPH print head, which is, for the purpose of this invention, equivalent to the OmniDot 760/GS8.

Figure 5:
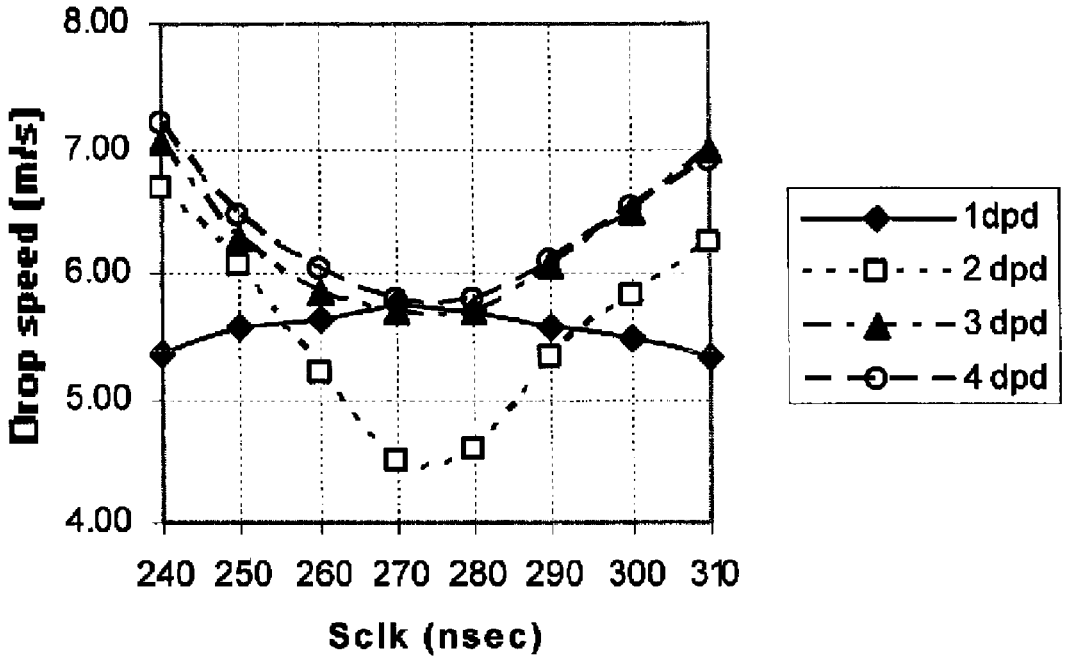
FIG. 5 shows drop speed variations as a function of fire frequency for different droplets-per-drop, using a standard waveform for driving a multipulse grayscale print head.

The performance of an UPH print head, operated with the embedded standard drive waveform, is depicted in FIG. 5. The standard drive waveform used is as schematically shown in FIG. 4 wherein the duration of the channel expansion period C is 9*Sclk, the duration of the channel contraction period X is 18*Sclk and the duration of the dwell period D equals 3*Sclk. The Sclk (Sample Clock) is the smallest time unit, i.e. the resolution, of the print head drive waveform and may for example be expressed in nanoseconds (ns) as shown in FIG. 5. One (1) Sclk time unit represents one (1) bit in a drive waveform representation. The standard drive waveform may therefore also be represented as a sequence of bits. In the example given the waveform may be described as 9-18-3 bits per droplet. Electrical limitations of the waveform drive circuitry, e.g. maximum voltage step, may require small changes to the waveform of FIG. 4.

FIG. 5 shows the drop speed variations as a function of fire frequency for different dpd's. At the abscissa the fire frequency is represented by the variable Sclk (Sample Clock) which relates to the fire frequency as:

$$\text{Fire frequency}=(\text{Sclk}*32*\text{max.dpd}*3)^{-1}$$

The results shown in FIG. 5 have been obtained by operating the UPH print head with Anuvia Cyan ink, commercially available from Agfa-Gevaert (BE), at a jetting temperature of 45° C. and driven with the embedded standard drive waveform as illustrated in FIG. 4, at a voltage of 17V.

If FIG. 5 shows that the drop speed of a multidroplet drop is lower than that of the single-droplet drop, it means that all the ejected droplets of the multidroplet drop did not merge into a single drop before reaching the receiving medium, i.e. the droplet speed of one of the later ejected droplets was too low to catch up with the previous ejected droplets. On the graph the speed of the slower droplet of the multidroplet drop is shown. E.g. for a Sclk between about 260 and 290 ns the 2 dpd drop seems to be slower than the 1 dpd drop, meaning that the $2^{nd}$ droplet does not merge into the $1^{st}$ droplet to form a single multidroplet drop. This is of course not a preferred operating condition.

An important conclusion from the graph is that (i) where the 1 dpd drop speed is maximal, the 2 dpd drop does not merge, and (ii) where the multidroplet drop speeds are maximal, the 1 dpd drop is too slow.

There does not exist an operating window wherein all grayscale drops have a comparable drop speed (e.g. drop speed differences <5%) and a high enough absolute drop speed (e.g. drop speed >6 m/s) to be suitable for high speed printing applications. From the data in FIG. 5, the best operating condition would be at a Sclk of 250 ns, at which all multidroplet drops merge but with a drop speed variation between the 1 dpd and 4 dpd drop of about 0.9 m/s.

A 0.9 m/s slower drop at a nominal drop speed of 6.5 m/s results in the drop reaching a receiving medium at a distance of 1 mm from the print head, about 0.016 ms later. At the higher printing speeds in industrial printing application, i.e. higher relative velocities between the print head and the receiving medium during the printing process, this landing delay shows up as a dot placement error on the printed receiving medium. For example, at a printing speed of 0.8 m/s, the 0.9 m/s slower 1 dpd drop shows as a dot placement error of about 12 μm. At a print resolution of 360 dpi, i.e. about 70 μm between neighboring dots, this dot placement error may result in visible print artifacts for example at the edge of a high density solid area on a low density background. That is, the change from 4 dpd printing (high density) to 1 dpd printing (low density) results in all the 1 dpd drops, just after the edge of the solid area, landing too late, thereby increasing the inter-dot distance of 70 μm to about 82 μm. This systematic shift in inter-dot distance shows on the print as a visible interleaved white line.

So, drop velocity variations between grayscale drops at printing speeds used in industrial printing applications may have unacceptable consequences for the quality of the printed matter.

A solution to the above described problem is provided by a printing method wherein grayscale performance is traded for printing speed. The printing method according to the invention avoids the printing of 1 dpd drops from a multipulse grayscale print head. That is, a first droplet is never printed as a standalone drop but always as part of a multidroplet drop. Again looking at the test result depicted in FIG. 5, the drop speed variations at a Sclk of 250 ns, between multidroplet drops, is less than 0.4 m/s. This is less than half the variation between a 1 dpd and a 4 dpd drop at the Sclk of 250 ns, resulting in a drop placement accuracy improvement with more than 50%.

The loss of one gray level from the grayscale print head may be compensated by proper multilevel halftoning, which is an image processing technique that creates the appearance of intermediate tone levels by spatial modulation of the remaining gray levels from the grayscale print head. Multilevel halftoning is well known in the art and an embodiment for use with grayscale inkjet print heads is disclosed in EP 1 239 660. Using multilevel halftoning techniques an image file can be created that is printed with multidroplet drops only, thereby avoiding the use of the problematic single-droplet (1 dpd) drop, and keeping acceptable grayscale image quality.

It is to be understood that the basic characteristics of the multipulse grayscale print head are not altered with the use of the printing method according to the invention, i.e. the print head keeps its ability to generating 1 dpd drops, but it is driven in such a way that the 1 dpd drop is not used. In this embodiment of the invention, the smallest drop used in the printing process now is the 2 dpd drop having a drop volume substantially double the smallest drop volume intrinsically available from the print head (i.e. the volume of the 1 dpd drop). That is, the smallest printed detail is now twice the size of what the multipulse grayscale print head is intrinsically capable of printing. An advantage of the printing method disclosed above is that it may be used with any multipulse grayscale print head, since it does not alter the print head but the image data the print head is supposed to print.

Figure 6:
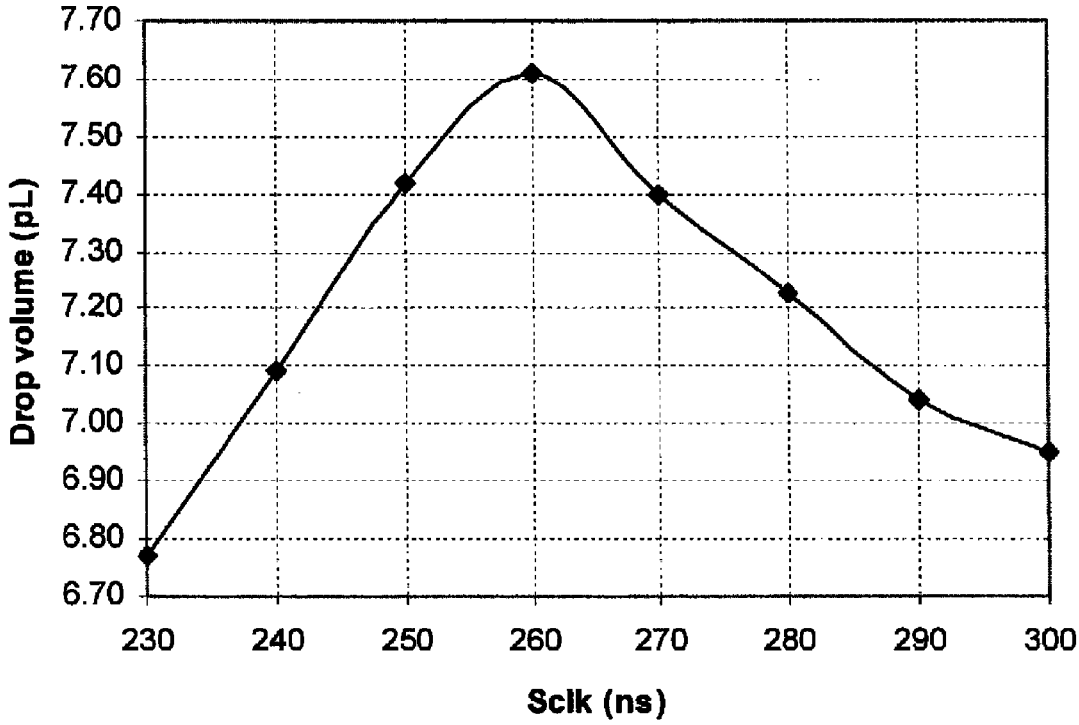
FIG. 6 shows droplet volume of a first droplet as a function of sample clock, using a standard waveform for driving a multipulse grayscale print head.

In a more preferred embodiment of the printing method, and insofar the print head electronics allows to, the drive waveform responsible for generating the first droplet in a series of droplets of the multidroplet drop is adjusted such that the droplet volume of the first droplet in the series of droplets is reduced. The effect of this waveform adjustment is that it brings the size of the smallest printable detail using the printing method, i.e. the 2 dpd dot, more closely to the intrinsic smallest printable detail by the grayscale print head, i.e. the 1 dpd dot. This preferred embodiment of course requires access to the waveform(s) that drive the multipulse grayscale print head, for example through downloading of another waveform description into the print head electronics. One approach to modifying the drive waveform of the $1^{st}$ droplet may be to change the width of the drive pulses of the $1^{st}$ droplet waveform. For example, with reference to FIG. 4, a shorter or longer time between the leading edge 41 (i.e. the underpressure generating event) of the channel expansion pulse and the trailing edge 42 (i.e. the pressure generating event) of the channel expansion pulse reduces the volume of the droplet that is ejected. This effect is illustrated in FIG. 6 showing the droplet volume of a 1 dpd drop as a function of the sample clock. The data in FIG. 6 have been obtained with a UPH print head operating with Anuvia Cyan ink, at a jetting temperature of 45° C. and a drive voltage of 17V. The waveform used is the embedded standard drive waveform as illustrated in FIG. 4. The width of the 9 bit channel expansion pulse is changed by changing the sample clock which alters the duration of 1 bit. The width or duration of the channel expansion pulse equals 9*Sclk in ns units. FIG. 6 shows that the 1 dpd drop volume is maximal at a sample clock of 260 ns, which corresponds with a mode of operation wherein the pressure generating edge 42 of the channel expansion pulse (i.e. the trailing edge 42) reinforces the overpressure present in the ink chamber and resulting from the reverberated underpressure wave generated by the underpressure edge 41 of the channel expansion pulse (i.e. the leading edge 41). As the sample clock changes, the operation of the print head moves away from this maximal reinforcement mode, i.e. timing of the underpressure and overpressure generating edge 41 resp. 42 of the channel expansion pulse reduce this reinforcement effect and the resulting energy available in the ink chamber for droplet ejection is reduced, yielding smaller droplet volumes. Another approach may be to generate the $1^{st}$ droplet using a reduced drive voltage which reduces the energy that is input in the ink chamber for ejecting a droplet from the ink chamber.

Figure 7:
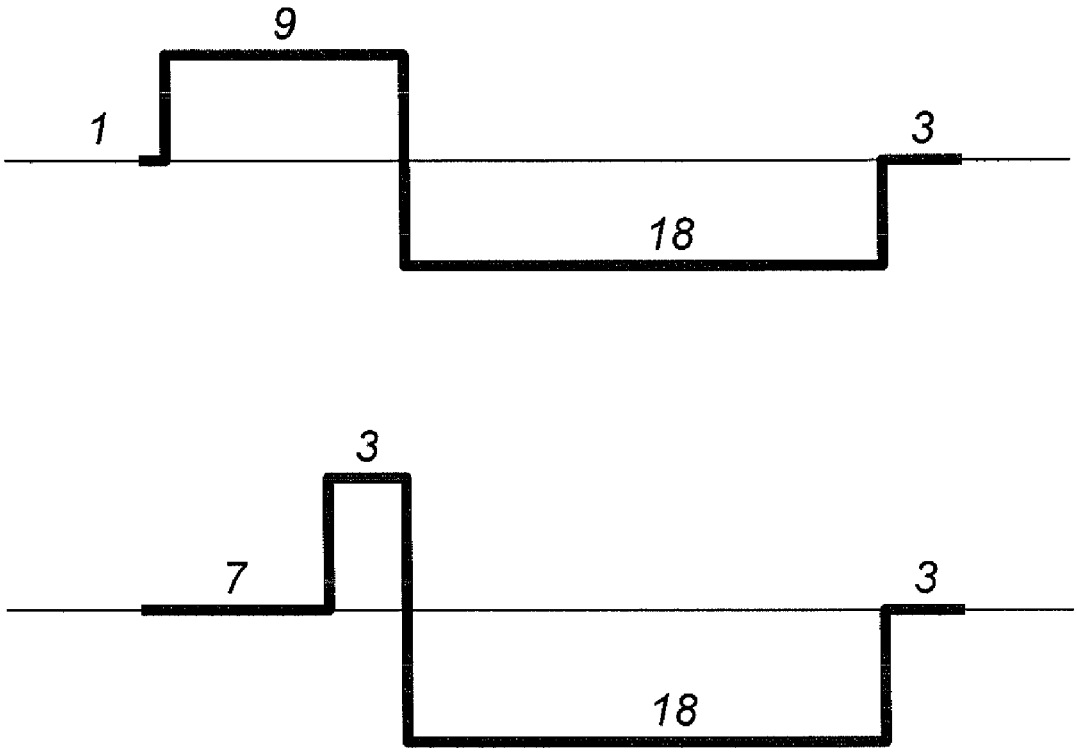
FIG. 7 shows a drive waveform altered to prevent ejection of a first droplet.

In an even more preferred embodiment of the printing method, the drive waveform for generating the first droplet in a series of droplets of the multidroplet drop is adjusted such that energy input in the ink chamber is insufficient to eject a first droplet from the ink chamber but is comparable to the residual energy left in the chamber after a first droplet would have been ejected. The effect of this waveform adjustment is that the smallest printable detail, corresponding to a 2 dpd drop, actually is a single-droplet drop comprising only the $2^{nd}$ droplet. The difference with the straightforward printing of a 1 dpd drop as the smallest printable detail is that the $2^{nd}$ droplet in the 2 dpd drop starts from an energetic condition in the ink chamber "as if a $1^{st}$ droplet was ejected". A $1^{st}$ droplet drive waveform that may be used for this purpose is illustrated in the lower part of FIG. 7. The upper drive waveform in FIG. 7 is the embedded standard drive waveform as illustrated in FIG. 4. This standard drive waveform may be represented as a 1-9-18-3 waveform: i.e. 1 bit inactivity, followed by 9 bit channel expansion, in turn followed by 18 bit channel contraction and ending with 3 bit channel dwell time, wherein the duration of each bit equals the sample clock value Sclk in ns units. The lower drive waveform has a modified channel expansion pulse. The lower drive waveform is represented as a 7-3-18-3 waveform. The total duration of the modified waveform is equal to the standard drive waveform but the channel expansion pulse is made that short, i.e. from 9 bit to 3 bit, that the reinforcement effect as described in the paragraph above is completely absent and that the resulting energy available in the chamber is insufficient to eject and an ink droplet through the nozzle.

The invention is advantageously used in industrial printing application where high printing speeds are required. Preferably the invention is used in combination with printing speeds above 0.8 m/s, i.e. a relative velocity between the receiving medium and the multipulse grayscale print head is above 0.8 m/s.

Although the invention has been successfully implemented using the UPH print head from Agfa-Gevaert, the inventors envision that the invention is also applicable to other types of piezoelectric multipulse grayscale print heads because the phenomena underlying the problem that is solved are common for most multipulse grayscale print heads, i.e. a first droplet in a series of successively ejected droplets always experiences different starting conditions compared to successive droplets. That is, a first droplet can not benefit from residual energy in the ink chamber, whereas successive droplets do benefit from the residual energy from previous ejection processes. Therefore in standard conditions, the first droplet will always have deviating properties.

The invention is neither limited to multipulse grayscale print heads of the piezoelectric type. The use of multipulse thermal ink jet print heads may also benefit from the invention as the residual thermal energy in the ink chamber after a first droplet is ejected may result in multidroplet drops having different properties compared to the single-droplet drop.

It will be appreciated by those skilled in the art that the problem underlying the invention is related to a multipulse grayscale print head, the way the print head is driven and the way the energy applied to the ink is transferred into drop ejection. The invention therefore is not restricted to any type of ink used in the print head, operating conditions of the print head or whatsoever.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A method for inkjet printing an image onto a receiving medium, the method comprising the steps of:

providing a grayscale inkjet print head having an ink chamber and an electrically actuable device associated with the ink chamber and arranged to eject droplets from the ink chamber;

driving the electrically actuable device to eject a number of successive ink droplets from the ink chamber in accordance with print tone data provided to the grayscale inkjet print head, the number of successive ink droplets forming a multiple-droplet drop creating a printed dot of appropriate tone on the receiving medium, the number of successive ink droplets forming the multiple-droplet drop being $\geqq 2$; and preventing print tone data corresponding to the ejection of a single-droplet drop from being provided to the grayscale inkjet print head.

2. The method according to claim 1, wherein the print tone data corresponding to the ejection of the single-droplet drop is prevented from being provided to the grayscale inkjet print head by removing the print tone data corresponding to the ejection of the single-droplet drop from the print tone data that is provided to the grayscale inkjet print head.

3. The method according to claim 2, further comprising the step of:

driving the electrically actuable device with a number of successive electric signals, each electrical signal ejecting a corresponding droplet of the multiple-droplet drop; wherein a first electrical signal for ejecting a first droplet of the number of successive ink droplets is different from a subsequent electrical signal for ejecting a subsequent droplet of the number of successive ink droplets.

4. The method according to claim 3, wherein each of the electrical signals for driving the electrically actuable device is applied with a drive voltage, and a drive voltage of the first electrical signal is reduced with respect to a drive voltage of the subsequent electrical signal.

5. The method according to claim 3, further comprising the step of:

providing a relative movement between the grayscale inkjet print head and the receiving medium with a relative velocity higher than 0.8 m/s.

6. The method according to claim 1, wherein the print tone data corresponding to the ejection of the single-droplet drop is prevented from being provided to the grayscale inkjet print head by applying a multilevel halftoning technique for avoiding the use of the print tone data corresponding to the single-droplet drop during the generation of the print tone data for inkjet printing the image with the grayscale inkjet print head.

7. The method according to claim 6, further comprising the step of:

driving the electrically actuable device with a number of successive electric signals, each electrical signal ejecting a corresponding droplet of the multiple-droplet drop; wherein a first electrical signal for ejecting a first droplet of the number of successive ink droplets is different from a subsequent electrical signal for ejecting a subsequent droplet of the number of successive ink droplets.

8. The method according to claim 7, wherein each of the electrical signals for driving the electrically actuable device is applied with a drive voltage, and a drive voltage of the first electrical signal is reduced with respect to a drive voltage of the subsequent electrical signal.

9. The method according to claim 7, further comprising the step of:

providing a relative movement between the grayscale inkjet print head and the receiving medium with a relative velocity higher than 0.8 m/s.

10. The method according to claim 1, further comprising the step of:

driving the electrically actuable device with a number of successive electric signals, each electrical signal ejecting a corresponding droplet of the multiple-droplet drop; wherein a first electrical signal for ejecting a first droplet of the number of successive ink droplets is different from a subsequent electrical signal for ejecting a subsequent droplet of the number of successive ink droplets.

11. The method according to claim 10, wherein each of the electrical signals for driving the electrically actuable device includes at least one pulse, and a duration of the at least one pulse in the first electrical signal is shorter or longer than a duration of the at least one pulse in the subsequent electrical signal.

12. The method according to claim 10, wherein each of the electrical signals for driving the electrically actuable device is applied with a drive voltage, and a drive voltage of the first electrical signal is reduced with respect to a drive voltage of the subsequent electrical signal.

13. The method according to claim 1, further comprising the step of:

providing a relative movement between the grayscale inkjet print head and the receiving medium with a relative velocity higher than 0.8 m/s.

* * * * *